United States Patent [19]

Hayato et al.

[11] Patent Number: 4,973,363

[45] Date of Patent: Nov. 27, 1990

[54] ALUMINUM ALLOY AND METHOD FOR MAKING SAME

[75] Inventors: Ikeda Hayato, Okazaki; Sekiguchi Tunehisa, Yokohama; Yokoi Katsumi; Suzuki Kenji, both of Kitakata, all of Japan

[73] Assignees: Showa Denko Kabushiki Kaisha, Tokyo; Kabushiki Kaisha Toyoda Jidoshokki Seisakusho, Aichi, both of Japan

[21] Appl. No.: 217,687

[22] Filed: Jul. 11, 1988

[30] Foreign Application Priority Data

Jul. 11, 1987 [JP] Japan ..... 62-173463

[51] Int. Cl.[5] ..... C22F 1/04

[52] U.S. Cl. ..... 148/3; 148/417; 148/439

[58] Field of Search ..... 148/417, 439, 3

[56] References Cited

U.S. PATENT DOCUMENTS 4,648,918 3/1987 Asano et al. ..... 148/439

*Primary Examiner*—R. Dean

*Attorney, Agent, or Firm*—Spensley, Horn, Jubas & Lubitz

[57] ABSTRACT

The present invention is related to an aluminum alloy having an improved workability and mechanical characteristics such as shear cutting ability, a high strength and a high abrasion resistance. The present invention is also related to a method for making the above-mentioned alloy.

There is provided by the present invention an aluminum alloy having an improved shear cutting characteristics comprising; from 8 to 13 weight percent of silicon, from 2.5 to 6 weight percent of copper, from 0.3 to 1.2 weight percent of magnesium, from 0.25 to 1.0 total weight percent of iron and/or manganese, from 0.005 to 0.25 total weight percent of titanium and boron, and the balance consisting of aluminum and impurities, whereby more than 80 percent of an arbitrary sectional surface is covered by equi-axial crystal, silicon crystal in aluminum-silicon eutectic structure is 8 μm at most in diameter, and surface hardness is between 67 and 75 according to the Rockwell hardness scale F.

There is also provide by the present invention a method for making an aluminum alloy having an improved shear cutting characteristics, the method comprising the steps of: (a) preparing a molten raw material including from 8 to 13 weight percent of silicon, from 2.5 to 6.0 weight percent of copper, from 0.3 to 1.2 weight percent of magnesium, from 0.25 to 1.0 weight percent of iron and/or manganese, from 0.005 to 0.25 total weight percent of titanium and boron, and aluminum filling the rest together with impurities; (b) casting the molten raw material at a solidification speed not less than 4° C./sec to a temperatue lower than a solidfying temperature of the material so that more than 80 percent of arbitrary sectional surface is covered by equi-axial cristal and a silicon crystal in aluminum-silicon eutectic structure is 8 μm at most in diameter; and (c) heat treating the material so that a hardness thereof becomes between 67 and 75 according to the Rockwell hardness scale F.

12 Claims, 5 Drawing Sheets

Magnification Factor 1.37

Magnification Factor 1.37

ALUMINUM ALLOY AND METHOD FOR MAKING SAME

BACKGROUND OF THE INVENTION

The present invention is related to an aluminum alloy having an improved workability and mechanical characteristics such as shear cutting ability, a high strength and a high abrasion resistance. The present invention is also related to a method for making the above-mentioned alloy. The alloy provided by the present invention has characteristics suitable for plastic working and for being used for cylinder sleeves and pistons in internal combustion engines and for guide cylinders for guiding magnetic tapes in video tape recorders (VTRs), for example.

Aluminum alloys containing a certain amount of silicon therein, that is an aluminum-silicon alloy, are being used for pistons of internal combustion engines and guide rollers in VTRs. Some of the examples of such alloys are named AC8A (AA336), AC8B and AC8C (AA332) which are used for casting, ADC12 (A383, A384) used for die casting, and A4032 used for wrought and forging. In general, aluminum-silicon alloys have common characteristics such as high temperature strength, high abrasion resistance and high corrosion resistance. But the characteristics are modifiable, according to the requisitions required to the alloy in various cases, by varying the composition, manufacturing process and heat treatment thereof. That is, one of the above characters may be emphasized by suitably determining the composition. For example, alloy A4032 has a superior mechanical strength and abrasion resistance at high temperatures and small coefficient of thermal expansion. When processing the alloy A4032 which is smaller than 100 mm in diameter, for example, raw material is extruded and cut out by a sawing machine for further processing.

Requirement for a raw material is determined by the characteristics required in relation to a final product. But it is also required or necessary that the raw material has the characteristics which enable and facilitate processing thereon while processing it to make the final product. The characteristics required in relation to the processing thereof are plastic workability, working ability and shear cutting ability. Shear cutting ability is important to simplify the process because cutting by shear is much simpler than cutting by a lathe machine, for example. The effects of this simplification become even stronger in a mass production. But, because the shear cutting ability is contradictory to ductility and toughness of the material, it was difficult to obtain an aluminum-silicon alloy having both a good shear cutting ability and such mechanical characteristics as ductility and toughness. For example, when the alloy A4032 is cut by shear, cracks appear in the cut surface and the surface becomes rough, and the product is not suitable for forging. On the other hand, because the alloy A4032 does not have a high fatigue strength, the alloy is not suitably used in pistons and connecting rods. As typically seen in the alloy A4032, an aluminum-silicon alloy having a high abrasion resistance, stress-corrosion resistance, strength at high temperatures, fatigue resistance and shear cutting ability has not been provided by now.

SUMMARY OF THE INVENTION

It is, therefore, a primary object of the present invention to provide an aluminum-silicon alloy which has a high abrasion resistance, stress-corrosion resistance, high strength at high temperatures, high fatigue resistance and high shear cutting ability. A secondary object of the present invention is to provide a method for fabricating an alloy having the above-mentioned characteristics. Through intensive studies on Al-Si-Cu-Mg-Fe-Mn alloys which have superior high temperature strength and abrasion resistance, inventors have found an alloy which satisfies the above-mentioned requirements and a method for making the alloy.

In a first aspect of the present invention, there is provided an aluminum alloy having an improved shear cutting characteristics comprising: from 8 to 13 weight percent of silicon, from 2.5 to 6 weight percent of copper, from 0.3 to 1.2 weight percent of magnesium, from 0.25 to 1.0 total weight percent of iron and/or manganese, from 0.005 to 0.25 total weight percent of titanium and boron, and the balance consisting of aluminum and unavoidable impurities included therein, whereby more than 80 percent of an arbitrary sectional surface is covered by equi-axial crystal, silicon crystal in aluminum-silicon eutectic structure is 8 um at most in diameter, and surface hardness is between 67 and 75 according to the Rockwell hardness scale F.

In a second aspect of the present invention, there is provided a method for making an aluminum alloy having an improved shear cutting characteristics, the method comprising the steps of: (a) preparing a molten raw material including from 8 to 13 weight percent of silicon, from 2.5 to 6.0 weight percent of copper, from 0.3 to 1.2 weight percent of magnesium, from 0.25 to 1.0 total weight percent of iron and manganese, from 0.005 to 0.25 total weight percent of titanium and boron, and aluminum filling the rest together with impurities; (b) casting the molten raw material at a solidification speed of not lower than 4° C./sec; and (c) heat treating the materials so that the hardness thereof becomes between 67 and 75 according to the Rockwell hardness scale.

Other objects and effects of the present invention will become clear through the following description.

DETAILED DESCRIPTION OF THE PREFERRED EMBODIMENTS

Figure 1:
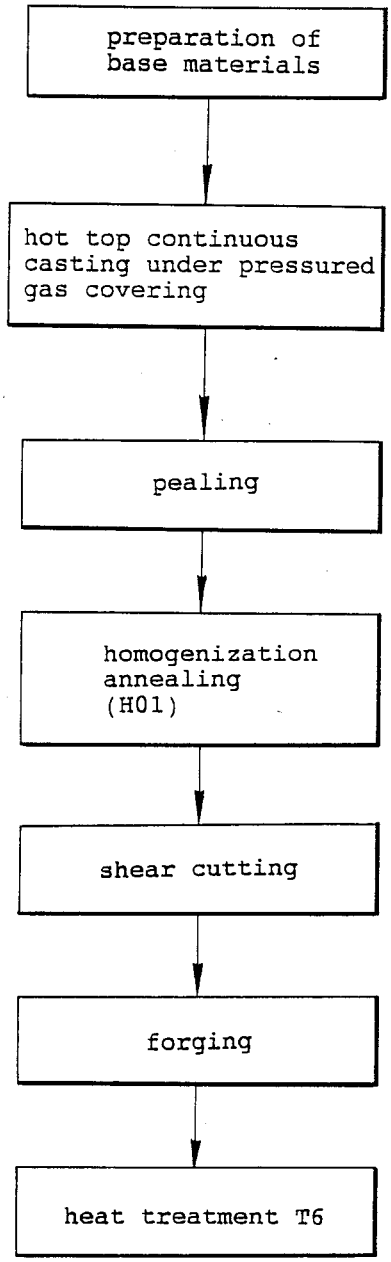
FIG. 1 is a flow chart showing the method for fabricating an aluminum-silicon alloy according to an embodiment of the present invention.

Preferred embodiments of the present invention will now be described in detail with reference to the attached drawings.

Before getting into detailed examination on the characteristics of the alloy, shear cutting ability was defined, for the following analysis, as follows.

First characteristics conforming to a good shear cutting ability of a material is to have a smooth cut surface and to have little plastic deformation around the cut surface when being cut by a shear force. In other words, the first characteristics is to be cut straight in the direction of shear force at a flat and smooth surface without remaining deformations therearound. The materials must not have laminations due to segregations or impurities contained in the material, at least, in order to realize the first characteristics. Further, the material has to be fragile, in general, not to remain plastic deformation around the cut surface.

Second characteristics is not to have cracks in the cut surface. The material has to be ductile in order not to have cracks in the cut surface.

If a member obtained by shear cutting has a rough cut surface or a plastic deformation remaining therearound, exact dimensioning of the member becomes difficult. In such a case, a reforming process including abrasion or plastic deformation become necessary after the shear cutting. If a member has cracks in the cut surface, a portion having the cracks has to be abraded out or cut out of the member. These redundant processes performed after the shear cutting complicate the manufacturing process and obstacles an effective use of the raw material. Thus, the shear cutting ability is closely related to the productivity of the manufacturing process.

As has become clear by the above description, the material must have contradictory characteristics, fragility and ductility, in order to fill the requirements. Through intensive studies on Al-Si-Cu-Mg-Fe-Mn alloys which have superior high temperature strength and abrasion resistance, inventors have found an alloy which satisfies the above-mentioned requirements and a method for making the alloy.

Followings are the results of the studies which was made in relation to the present invention.

(1) Composition of base materials

By studying characteristics of various compositions and combinations belonging to the Al-Si-Cu-Mg-Fe-Mn alloys, it was found that the most desirable characteristics are obtained in an alloy comprising from 8 to 13 weight percent of silicon, from 2.5 to 6 weight percent of copper, from 0.3 to 1.2 weight percent of magnesium, from 0.25 to 1.0 weight percent of iron and/or manganese, from 0.005 to 0.25 total weight percent of titanium and boron, and the balance consisting of aluminum and unavoidable impurities contained therein. Followings are the effects of each base material in the alloy on the characteristics of the alloy.

Silicon generally decreases thermal expansion coefficient and increases abrasion resistance of the alloy. But, excessive amount of silicon decreases the cutting ability, forging ability and extrusion ability of the alloy. Between 8 and 13 weight percent of silicon results in a maximum strength and fatigue resistance in Aluminum-Silicon alloys.

Copper increases the strength, abrasion resistance and cutting ability of the alloy by forming a solid solution therefrom in the alloy. But, if the amount of copper is lower than 2.5 weight percent, these characteristics are not sufficiently improved. On the other hand, when the proportion of copper is higher than 6 weight percent, cracking and defective filling of molten material in the mold occur during a casting process which make it difficult to apply casting on the material. So, copper has to be between 2.5 and 6 weight percent.

When the proportion of magnesium is less than 0.3 weight percent, age hardening of the alloy becomes insufficient. On the other hand, when the proportion is larger than 1.2 weight percent, proportion of oxidized magnesium increases and cracks occur resulting in an degradation of structural characteristics of the alloy. Therefore, magnesium has to be between 0.3 to 1.2 percent.

Iron and manganese increases the re-crystallization temperature and improves mechanical characteristics at high temperatures. When iron and manganese is lower than 0.25 weight percent, their effect is not sufficient. When the amount is higher than 1.0 weight percent, ductility of the alloy is decreased because of the intrametallic compounds, such as Al-Mn-Fe and Al-Fe-Si, formed therein.

Titanium and boron serve for micronizing the crystal structure and thus for improving the strength and shear cutting ability. They are most effective when 0.08 weight percent and 0.02 weight percent of titanium and boron are added respectively. When their total amount is lower than 0.005 weight percent, they are not enough effective. When the total amount exceeds 0.25 weight percent, the effects decreases gradually according to the increase of the amount, and needle-like organization of aluminum-titanium develops and the alloy loses the ductility.

In addition to the above-mentioned base materials, other materials may be added. For example, if small amount of chromium or nickel is added, mechanical properties are improved at high temperatures. But because these elements decreases ductility and fatigue resistance, their amount has to be lower than 0.5 weight percent. Zinc forms an intrametallic compound and increases remarkably the strength and cutting ability. Therefore, 0.5 percent at most of zinc may be added to the alloy. Addition of strontium, sodium, calcium, potassium and phosphorus to molten alloy between 10 and 30 ppm suppresses development of silicon crystal in the eutectic structure, micronizes crystal structure of elements and increases mechanical properties and the shear cutting ability. Especially, when the alloy is hypereutectic and the molten alloy is cooled relatively slowly, one or some of the above-mentioned elements had better be added to the alloy as an inoculator.

(2) Microscopic and macroscopic structure of the alloy

Size and dispersion of silicon crystal, together with heat treatment described below, play an important role in determining shear cutting ability of the alloy.

Macroscopically, equi-axial crystal covers more than 80 percent of a cut surface and, preferably, feather structure does not exist substantially. Microscopically, average diameter of silicon crystal in the aluminum-silicon alloy has to be 8 um at the largest, preferably, 5 um at the largest. It is because a shear cut surface of the equi-axial crystal is smooth and that of the plumose crystal is rough and causes cracks.

Following is an example of the method for obtaining the above-mentioned metallurgical structure. The most important and distinctive part in the method comprises a cooling of the molten alloy at a solidification speed not lower than 4° C./sec. The solidification speed may be obtained by limiting the size of the mold and improving the cooling capacity of cooling means for cooling the mold and the product extracted from molds. In the experiments performed by the inventors, a massive specimen of which the diameter is 68 mm was cast according to the present invention. By virtue of the rapid cooling of the mold, segregation of base materials in the alloy is suppressed. The method is not restricted as described above but the method may be modified according to the size of the product and the solidification speed may be moderated when inoculation materials are employed.

When the alloy is hyper-eutectic, diameter of the primary crystal has to be smaller than 30 um in order to retain a good shear cutting ability.

(3) Hardness

Rockwell superficial hardness Hrf of the product after heat treatment has to be between 67 and 75, preferably between 69 and 73. When the hardness is lower than 67, cut surface becomes rough and the roughness remains as a flaw after being forged. When the hardness is higher than 75, cracks occur by the shear cutting and the cracks further extend by the forging. Therefore, heat treatment is performed so that the hardness falls in that range.

In the aluminum alloy according to the present invention, base metallic materials and silicon crystal are both micronized and the micronized deposition is scattered evenly in the alloy. Therefore, when a shear force is exerted on the alloy, the alloy is cut along a flat plane passing through grain boundaries. At a same time, as the ductility of the alloy is increased by virtue of the small grains, cracks are refrained from occurring. Further, by a proper proportion of the base materials, high temperature strength, corrosion resistance, stress-corrosion resistance, cutting ability and plastic workability of the alloy is improved.

As above-mentioned, the alloy according to the first aspect of the present invention realizes an improved high temperature strength, abrading resistance, stress-corrosion resistance, fatigue resistance, plastic workability, cutting ability and shear cutting ability by optimizing the composition of silicon, copper, magnesium, iron, manganese, titanium and boron, and further making the grain uniform and micronized. By using the present alloy in pistons and cylinders of an internal combustion engine, or guide cylinders of VTR for example, mechanical strength of these parts is improved. At a same time, fabrication process of the parts such as cutting and dimensioning thereof are simplified resulting in an improvement of workability and efficiency of the work. On the other hand, by virtue of the second aspect of the present invention, there is provided a method for making the above-mentioned alloy easily, certainly and cost effectively.

EXAMPLES

Characteristics of the alloys according to the present invention will be compared experimentally with other alloys.

(Method of Fabrication)

Table 1 shows a composition of base materials and a method for fabricating each specimen. FIG. 1 shows a flow chart of the method according to which the alloy of the present invention was fabricated. Thus obtained specimens are numbered from 1 to 28 corresponding to the proportion of silicon and other base materials. Specimens were fabricated by casting molten material at a solidification speed not lower than 4° C./sec by a gas pressurized hot top continuous casting method (a method disclosed in Japanese Second Publication No.54-42847) into a cast bar having a diameter of about 68 mm, pealing off the surface thereof by pealing means, and heat treating (called as a H01 heat treatment hereinafter) so that the surface hardness becomes between 67 and 75.

TABLE 1

| Speciment | base material weight % | | | | | | | | | | Method of making | |
|---|---|---|---|---|---|---|---|---|---|---|---|---|
| No. | Si | Cu | Mg | Fe | Mm | Cr | Zn | Ti + B | Ni | Na + Sr + Ca | casting | Heat Treatment |
| Present Invention | | | | | | | | | | | | |
| 1 | 8 | 2.6 | 0.4 | 0.3 | 0.3 | | | 1 | | | Continuously Cast Round Rod | $H_{01}$ |
| 2 | 8 | 4.5 | 0.8 | 0.3 | 0.8 | | | 0.01 | | | | |
| 3 | 8 | 2.6 | 0.4 | 0.6 | 0.3 | | | 0.01 | | | | |
| 4 | 8 | 2.8 | 0.4 | 0.6 | 0.7 | | | 0.01 | | | | |
| 5 | 8 | 2.7 | 0.4 | 0.6 | 0.7 | 0.2 | 0.3 | 0.01 | | | | |
| 6 | 8 | 4.5 | 0.6 | 0.6 | 0.7 | 0.2 | 0.3 | 0.01 | 0.25 | | | |
| 7 | 8 | 4.5 | 0.8 | 0.6 | 0.7 | 0.2 | 0.3 | 0.01 | 0.25 | 0.01 | | |
| 8 | 8 | 2.7 | 0.4 | 0.8 | 0.3 | | | 0.01 | | | | |
| 9 | 8 | 4.5 | 0.8 | 0.8 | 0.3 | 0.3 | 0.4 | 0.01 | | | | |
| 10 | 8 | 2.5 | 0.6 | 0.8 | 0.7 | | | 0.01 | | | | |
| 11 | 8 | 4.5 | 0.8 | 0.9 | 0.7 | 0.3 | 0.4 | 0.02 | | | | |
| 12 | 8 | 4.5 | 0.6 | 0.6 | 0.7 | | | 0.01 | 0.25 | 0.01 | | |
| 13 | 10 | 2.6 | 0.4 | 0.4 | 0.6 | | | 0.01 | | | | |
| 14 | 10 | 2.6 | 0.6 | 0.8 | 0.3 | | | 0.01 | | | | |
| 15 | 10 | 2.6 | 0.6 | 0.8 | 0.6 | 0.3 | | 0.01 | | | | |
| 16 | 10 | 2.6 | 0.8 | 0.8 | 0.6 | 0.3 | 0.4 | 0.01 | | | | |
| 17 | 10 | 4.5 | 0.4 | 0.6 | 0.3 | | | 0.01 | | | | |
| 18 | 10 | 4.5 | 0.6 | 0.6 | 0.6 | | 0.4 | 0.01 | | | | |
| 19 | 10 | 4.5 | 0.8 | 0.6 | 0.6 | 0.3 | | 0.01 | | | | |
| 20 | 11.5 | 2.6 | 0.4 | 0.3 | 0.3 | | | 0.01 | | | | |
| 21 | 11.5 | 2.6 | 0.6 | 0.3 | 0.3 | 0.2 | | 0.01 | | | | |
| 22 | 11.5 | 2.6 | 0.6 | 0.6 | 0.6 | | | 0.01 | | | | |
| 23 | 11.5 | 2.6 | 0.6 | 0.6 | 0.6 | 0.3 | | 0.02 | | | | |
| 24 | 11.5 | 2.6 | 0.6 | 0.6 | 0.6 | 0.3 | 0.4 | 0.15 | | | | |
| 25 | 11.5 | 4.5 | 0.3 | 0.3 | | | | 0.01 | | | | |
| 26 | 11.5 | 5.0 | 0.3 | 0.5 | | | | 0.01 | | | | |
| 27 | 11.5 | 4.5 | 0.6 | 0.6 | 0.3 | | | 0.01 | | | | |
| 28 | 11.5 | 4.5 | 0.8 | 0.6 | | 0.5 | 0.3 | 0.01 | 0.25 | 0.01 | | |
| Group 1 | | | | | | | | | | | | |
| 29 | 0.72 | 2.0 | 1.5 | | | | | 0.01 | 1.8 | | same as above | $H_{01}$ |

TABLE 1-continued

| Speciment | base material weight % | | | | | | | | | | Method of making | |
|---|---|---|---|---|---|---|---|---|---|---|---|---|
| No. | Si | Cu | Mg | Fe | Mm | Cr | Zn | Ti + B | Ni | Na + Sr + Ca | casting | Heat Treatment |
| 30 | 9.0 | 3.5 | 1.0 | | | | | 0.15 | 1.8 | | Molding | |
| 31 | 12.3 | 1.0 | 0.8 | 0.15 | | | | 0.01 | 1.0 | | same as below | |
| Group 2 | | | | | | | | | | | | |
| 32 | | | | | | same to 6 | | | | | Continuously | $H_{01}$ |
| 33 | | | | | | same to 12 | | | | | Cast Billets | |
| 34 | | | | | | same to 18 | | | | | | |
| Group 3 | | | | | | | | | | | | |
| 35 | | | | | | same to 6 | | | | | Continuously | $T_{02}$ |
| 36 | | | | | | same to 12 | | | | | Cast Round | |
| 37 | | | | | | same to 18 | | | | | Rods | |

Figure 2:
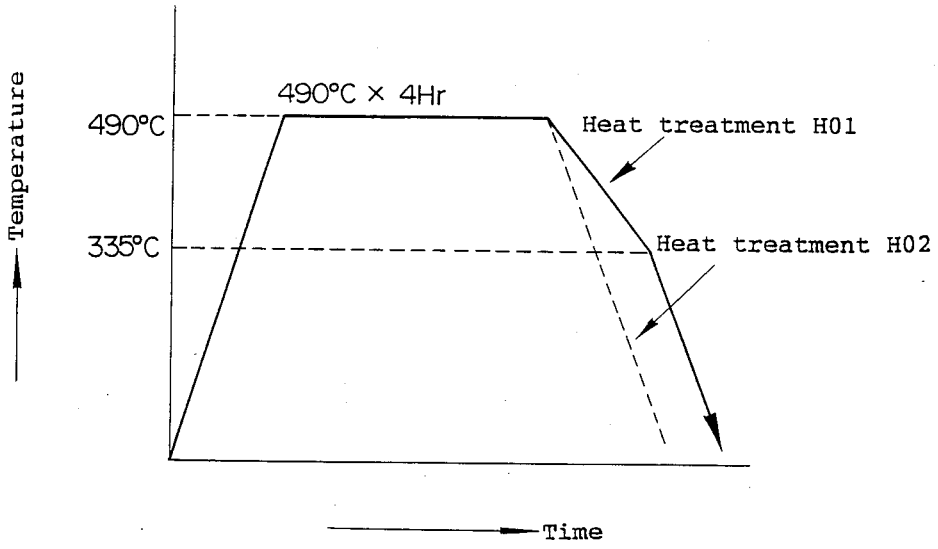
FIG. 2 is a graph showing a temperature versus time in an embodiment of the present invention.

As shown in FIG. 2, the heat treatment H01 includes the steps of maintaining the temperature of the product at 490° C. for 4 hours, decreasing the temperature at a rate equal to or lower than 60° C./hour down to 335° C. for example 40° C./hour, and decreasing the temperature at an ordinary rate of 60° to 80° C./hour. In FIG. 2, the heat treatment H01 is compared with an ordinary heat treatment for annealing H02 which comprises the steps of maintaining the temperature at 490° C. for 4 hours, decreasing the temperature to a room temperature at a rate of 60° to 80° C./hour. Tests on the mechanical properties except for hardness test, shear cutting ability test and forging ability test were performed on the specimens on which a heat treatment (T6) had been performed as in the actual cases. The heat treatment T6 includes the steps of maintaining the temperature at 500° C. for 4 hours, performing a hardening treatment by hot water and a synthetic aging process at a temperature of 170° C. for 8 hours, Comparative specimens of group 1, No.29 to No.31, are different from the above specimens in their composition and making process as shown in Table 1. Specimen No.29 is made of an Al-Cu-Mg alloy called A2218 suitable for forging works and the method employed for making the specimen was identical to that of the present invention except for the difference in composition. Specimen No.30 is made of AC8B suitable for casting works and was formed to a columnar form having a diameter of 68 mm by casting. Cooling speed of the molten material was 0.4° C./sec. Specimen 31 is made of A4032 having a composition which resembles to that of present invention and is suitable for forging works. The material was continuously cast into billets having a diameter of 250 mm and cooled at a cooling speed of 2° C./sec and extruded to a bar member having a diameter of 61 mm. Specimens of the group 1 were heat treated according to the heat treatment of H01.

Comparative specimens of group 2, No.32 to No.34, are identical to specimens of the present invention, No.6, No.12 and No.18 respectively, in their compositions. The difference is in that the billet casting was employed for the group 2 as in the case of specimen No.31 of group 1. Diameter of the specimen is also 61 mm and the heat treatment was H01.

Comparative specimens of group 3, No.35 to No.37, are identical to the present invention, No.6, No.12 and No.18, in their compositions and casting method. But, an ordinary heat treatment H02 is employed for the group 3.

By comparing the characteristics of the products which are obtained under the above described conditions, not only the effects of composition but also the effects of casting and heat treatment, which play an important role in the invention, has become clear.

(Test Items)

Test pieces are cut out of the thus obtained specimens and following tests were performed.

(1) Test on cut surface structure and grain size

Figure 3:
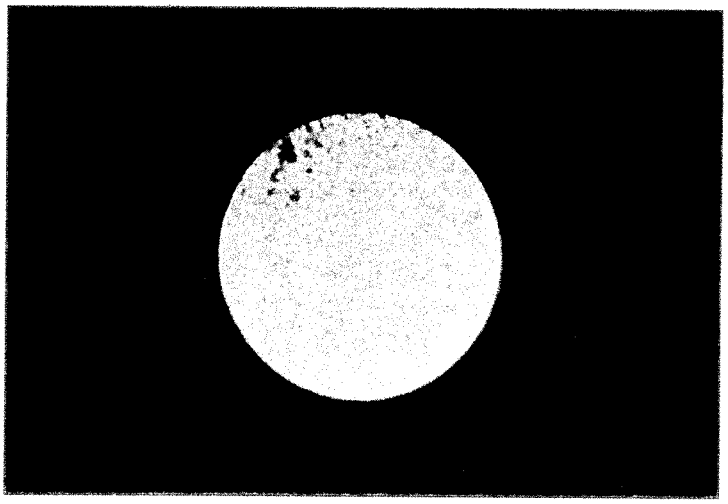
FIG. 3 is a photograph showing a cut surface of an aluminum-silicon alloy according to the present invention.
Figure 4:
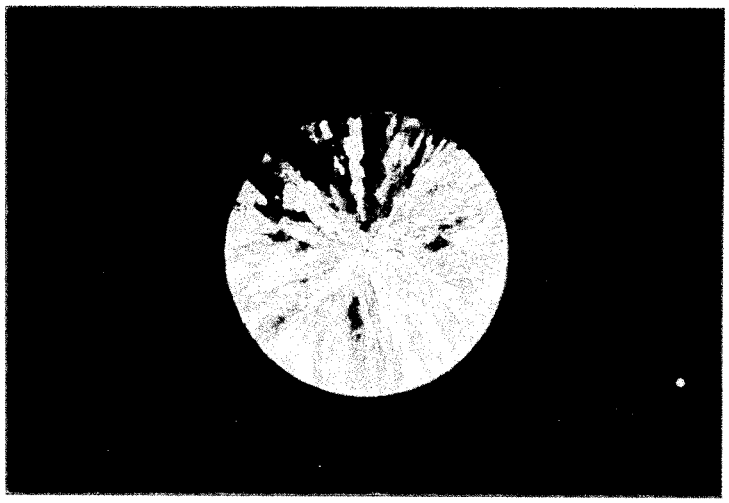
FIG. 4 is a photograph showing a cut surface of an aluminum-silicon alloy for comparison (not showing the present invention).
Figure 5:
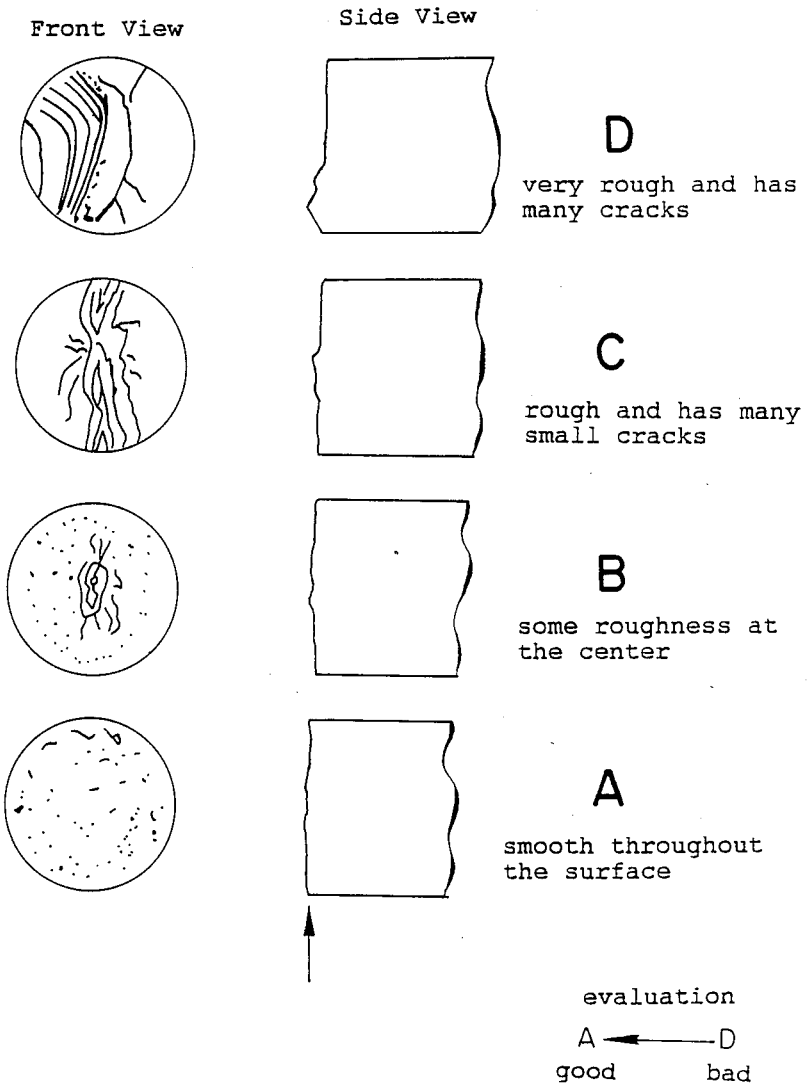
FIG. 5 is a sketch showing a surface cut by shear.

Test pieces cut out from the above-mentioned specimens were subjected to a homogenization treatment at a temperature of 490° C. Then a cut surface was abraded and etched. Photographs, FIGS. 3 and 4, are taken and the cut surface structure and the grain size were examined.

(2) Hardness Test

Hardness test has been performed according to the Rockwell Superficial Hardness Test (F Scale) after performing the heat treatment.

(3) Shear Cutting Ability Test

Test pieces, 40 mm in diameter, was cut by shear force after the heat treatment by means of a shear cutter having a maximum force of 160 ton, 65 reciprocations per minutes and 140 mm of stroke. The clearance between the test piece and the cutter was 0.2 mm. Shear cut surface was examined by visual observation and the smoothness was evaluated according to the roughness and cracks observed in the cut surface.

(4) Forging Ability Test

Figure 6:
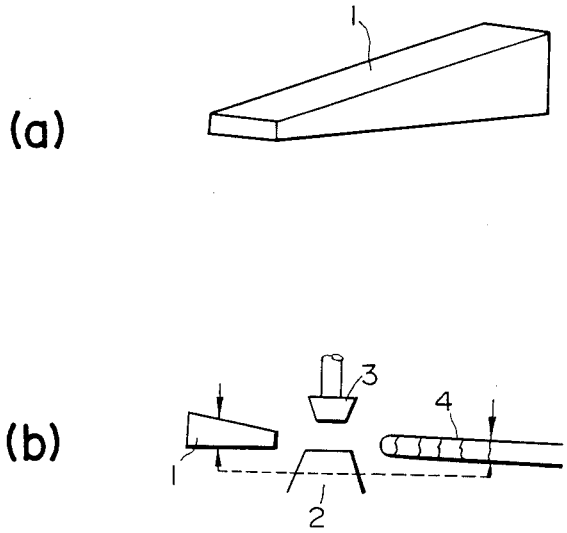
FIG. 6 shows a method of forging ability test.

Heat treated specimens are formed to wedge shaped test pieces as shown FIG. 6, annealed at a temperature of 360° C. for 1 hour, hammered by hammers 3, and a critical manufacturing ratio was evaluated by observing cracks 4 appeared on the surface.

(5) Tension Strength Test

After performing the above-mentioned T6 process, a tensile force is exerted on the test pieces by means of an Orsen multi purpose testing machine whose maximum load is 10 ton.

(6) Fatigue Test

Fracture strength of test pieces is measured after giving it $10^7$ times of repeated deformation.

(7) High Temperature Tensile Strength Test

High temperature tensile strength test was performed on the test pieces after keeping them at a temperature of 200° C. for 30 minutes by means of a high temperature tensile strength testing machine.

(8) Surface Roughness

After cutting a surface of the test pieces by a diamond cutter of a cutting machine, the surface is mirror finished and the roughness of the surface was measured by a surface roughness measuring instrument.

(9) Abrasion Resistance Test

Abrasion resistance test was performed by means of a Okoshi abrasion resistance tester with a friction speed of 3.1 m/sec, load of 18.9 kg, total friction distance of 600 m with a tester material made of cast iron (FC30).

(10) Cutting Ability Test

Figure 7:
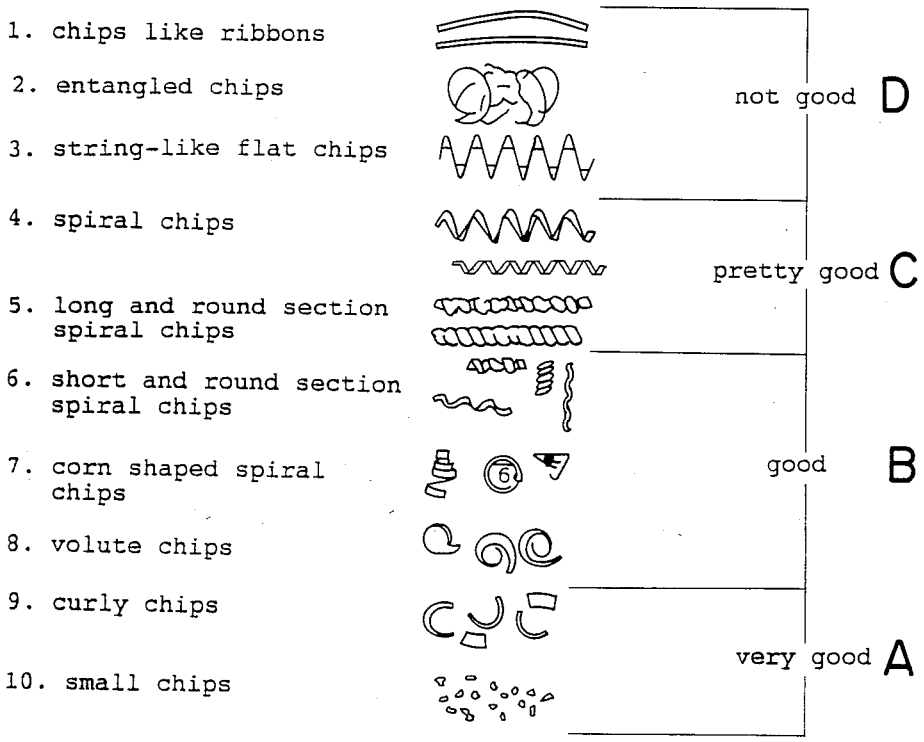
FIG. 7 shows a method of cutting ability test.

Cutting ability of the material was evaluated by the disposability of the chips, as shown in FIG. 7, when test pieces were cut by means of a cemented carbide cutter with a cutting speed of 200 m/min and a cutting depth of 0.15 mm.

(Test Results)

(1) Structure of Cut Surface

Structures of cut surfaces are shown in FIGS. 3 (sample No.18) and FIG. 4 (sample No.34) corresponding to an alloy of the present invention and a different alloy for comparison, respectively.

As shown in FIG. 3, equi-axial crystal covers more than 80% of the cut surface, a grain size of the eutectic crystal of aluminum and silicon is smaller than 8 um and the structure is uniform and micronized. On the contrary, microscopic structure of the alloys in the groups 1 and 2 have large columnar crystals as shown in FIG. 4. As to the alloys in the group 3, though not being shown in the figures, the alloy has micronized grains as small as that of the present invention.

(2) Other Test Results

Test results other than above are shown in Table 2. Hardness of the test pieces according to the present invention is between 66 and 73 according to the Rockwell Hardness Scale F. Reference test pieces on which the heat treatment H01 has been performed have a hardness between the same range. But the test pieces on which the heat treatment H02 has been performed have a hardness larger or smaller than the range.

Shear cutting ability of the test pieces according to the present invention was superior to the reference test pieces, the fact proving a superior characteristics obtained by the present invention.

Forging ability of the test pieces according to the present invention is superior to that of the reference test pieces. It is also found that the smaller the grain size and the greater the elongation properties of the alloy, the better is the forging ability of the alloy.

The more silicon and copper contained in the alloy, the higher the maximum tensile strength and the yielding strength becomes.

TABLE 2

| Speciment No. | Eutectic Size | Hardness | Shear Cutting Ability | Forging Ability | Tensile Strength kg/mm | Yield Strength kg/mm | Extension | Fatigue Strength | H. Temp Strength kg/mm | Surface Roughness | Abrasion Ratio $\times 10^7$ $mm^2/kg$ | Cutting Ability |
|---|---|---|---|---|---|---|---|---|---|---|---|---|
| Present Invention | | | | | | | | | | | | |
| 1 | 6 | 68 | B | A | 42.1 | 34.5 | 4.1 | 18.9 | 20.5 | 0.58 | 12.6 | C |
| 2 | 6 | 70 | B | " | 43.3 | 35.5 | 4.5 | 19.5 | 20.8 | 0.43 | 11.6 | C |
| 3 | 7 | 67 | B | " | 41.7 | 34.2 | 3.9 | 18.8 | 21.0 | 0.62 | 12.6 | C |
| 4 | 6 | 67 | B | " | 42.0 | 34.4 | 4.1 | 18.6 | 19.8 | 0.54 | 12.4 | C |
| 5 | 6 | 66 | B | B | 41.8 | 34.2 | 3.6 | 17.8 | 21.9 | 0.61 | 12.0 | B |
| 6 | 6 | 72 | A | " | 42.9 | 35.2 | 3.6 | 18.2 | 22.0 | 0.50 | 11.8 | B |
| 7 | 4 | 68 | A | " | 43.8 | 35.9 | 3.8 | 19.7 | 20.3 | 0.48 | 11.9 | B |
| 8 | 4 | 73 | B | A | 41.6 | 34.1 | 4.2 | 19.2 | 19.6 | 0.53 | 12.3 | C |
| 9 | 3 | 71 | B | B | 42.8 | 35.0 | 3.4 | 18.4 | 18.4 | 0.42 | 11.8 | B |
| 10 | 4 | 72 | B | A | 40.9 | 33.5 | 3.8 | 18.4 | 19.3 | 0.56 | 12.2 | C |
| 11 | 6 | 70 | A | B | 43.6 | 35.7 | 3.6 | 18.7 | 22.2 | 0.43 | 11.6 | A |
| 12 | 6 | 68 | B | " | 42.8 | 35.0 | 3.9 | 17.8 | 19.7 | 0.47 | 11.5 | C |
| 13 | 5 | 67 | B | A | 38.5 | 31.6 | 4.2 | 17.3 | 20.1 | 0.48 | 12.4 | C |
| 14 | 4 | 67 | B | " | 41.1 | 33.7 | 3.8 | 17.0 | 21.2 | 0.52 | 12.3 | C |
| 15 | 4 | 68 | B | " | 41.8 | 34.2 | 3.6 | 17.8 | 22.0 | 0.56 | 11.9 | C |
| 16 | 6 | 69 | B | B | 42.2 | 34.6 | 4.2 | 18.6 | 22.1 | 0.63 | 11.8 | A |
| 17 | 6 | 69 | B | " | 41.8 | 34.2 | 4.0 | 17.7 | 21.5 | 0.48 | 11.6 | C |
| 18 | 6 | 70 | B | " | 43.1 | 35.3 | 3.6 | 17.8 | 23.0 | 0.42 | 11.4 | A |
| 19 | 3 | 72 | B | " | 42.2 | 34.6 | 4.3 | 19.0 | 20.8 | 0.43 | 11.9 | B |
| 20 | 4 | 68 | B | A | 42.5 | 34.8 | 4.1 | 19.1 | 21.6 | 0.53 | 12.1 | C |
| 21 | 4 | 69 | B | " | 43.8 | 35.9 | 3.1 | 19.7 | 20.8 | 0.54 | 12.0 | C |
| 22 | 4 | 71 | B | " | 45.2 | 37.0 | 3.3 | 20.0 | 22.0 | 0.61 | 12.0 | C |
| 23 | 5 | 72 | B | " | 44.8 | 36.7 | 3.2 | 18.8 | 20.6 | 0.52 | 12.2 | B |
| 24 | 6 | 70 | B | B | 43.5 | 37.2 | 2.5 | 20.8 | 23.2 | 0.61 | 11.8 | A |
| 25 | 6 | 71 | A | A | 46.6 | 38.2 | 4.0 | 21.0 | 21.5 | 0.51 | 11.5 | C |
| 26 | 5 | 72 | A | " | 47.5 | 38.9 | 3.8 | 21.2 | 21.6 | 0.40 | 11.6 | C |
| 27 | 4 | 70 | A | B | 46.8 | 38.3 | 4.3 | 21.5 | 23.6 | 0.45 | 11.3 | B |
| 28 | 4 | 70 | A | " | 47.2 | 38.7 | 2.3 | 21.3 | 23.4 | 0.48 | 11.1 | A |
| Group 1 | | | | | | | | | | | | |
| 29 | / | 68 | D | " | 41.5 | 29.5 | 17.0 | 17.0 | 12.6 | 0.47 | 13.8 | D |
| 30 | 20 | 70 | C | C | 32.2 | 28.6 | 2.0 | 12.5 | 22.1 | 0.67 | 12.2 | B |
| 31 | 14 | 73 | D | B | 36.6 | 30.9 | 6.0 | 16.8 | 16.4 | 0.68 | 11.8 | D |
| Group 2 | | | | | | | | | | | | |
| 32 | 18 | 72 | D | " | 41.5 | 34.1 | 3.5 | 17.6 | 21.3 | 0.52 | 12.2 | B |
| 33 | 22 | 69 | D | " | 40.2 | 32.9 | 3.6 | 16.7 | 18.5 | 0.51 | 12.2 | C |
| 34 | 20 | 73 | D | " | 39.7 | 32.5 | 3.4 | 16.4 | 21.2 | 0.40 | 12.0 | A |
| Group 3 | | | | | | | | | | | | |
| 35 | 6 | 80 | D | " | 42.7 | 34.7 | 3.7 | 18.3 | 22.1 | 0.51 | 11.7 | B |
| 36 | 6 | 47 | D | " | 42.8 | 34.8 | 3.8 | 17.8 | 19.8 | 0.48 | 11.6 | C |
| 37 | 6 | 49 | D | " | 42.9 | 35.0 | 3.6 | 17.6 | 22.7 | 0.42 | 11.3 | A |

Fatigue resistance, high temperature tensile strength, abrasion resistance and forging ability are higher in the alloy of the present invention than in the reference test pieces. It is presumed that the superior characteristics of the present alloy is due to its higher ductility and strength realized by its micronized micro structure.

What is claimed is:

1. An aluminum alloy having improved shear cutting characteristics, comprising:

from 8 to 13 weight percent of silicon, from 2.5 to 6 weight percent of copper, from 0.3 to 1.2 weight percent of magnesium, from 0.25 to 1.0 weight percent of iron and/or manganese, from 0.005 to 0.25 total weight percent to titanium and boron, and the balance consisting of aluminum and unavoidable impurities, wherein more than 80 percent of an arbitrary sectional surface is covered by equi-axial crystal, silicon crystal in aluminum-silicon eutectic structure is 8 um at most in average diameter, the surface hardness is between 67 and 75 according to the Rockwell hardness scale F.

2. A method for making an aluminum alloy having improved shear cutting characteristics, the method comprising the steps of:

(a) preparing a molten raw material including from 8 to 13 weight percent of silicon, from 2.5 to 6.0 weight percent of copper, from 0.3 to 1.2 weight percent of magnesium, from 0.25 to 1.0 weight percent of iron and/or manganese, from 0.005 to 0.25 total weight percent of titanium and boron, and aluminum filling the rest with impurities;

(b) casting the molten raw material at a solidification speed not lower than 4° C./sec. to a temperature lower than a solidifying temperature of the material so that more than 80% of an arbitrary sectional surface is covered by equi-axial crystal and the silicon crystal in aluminum-silicon eutectic structure is 8 um at most in average diameter; and (c) heat treating the material so that the hardness thereof becomes between 67 and 75 according to the Rockwell hardness scale F.

3. An aluminum alloy according to claim 1, wherein the average diameter of the silicon crystals in the aluminum-silicon eutectic structure is not larger than 5 um.

4. An aluminum alloy according to claim 1 of which the surface hardness is between 69 and 73 according to the Rockwell hardness scale F.

5. An aluminum alloy according to claim 3 of which the surface hardness is between 69 and 73 according to the Rockwell hardness scale F.

6. A method of making an aluminum alloy according to claim 2, wherein the average diameter of the silicon crystals in the aluminum-silicon eutectic structure is not larger than 5 um.

7. A method for marking an aluminum alloy according to claim 2, wherein the material is heat treated so that the hardness of the material is between 69 and 73 according to the Rockwell hardness scale F.

8. A method for making an aluminum alloy according to claim 6, wherein the material is heat treated so that the hardness of the material becomes between 69 and 73 according to the Rockwell hardness scale F.

9. An aluminum alloy having equi-axial crystal structure covering more than 80 percent of arbitrary sectional surfaces thereof and silicon crystals in the aluminum-silicon eutectic structure not larger than 8 um in average diameter, the aluminum alloy obtained by a method including the steps of:

(a) preparing a melt of the alloy comprising from 8 to 13 weight percent of silicon, from 2.5 to 6 weight percent of copper, from 0.3 to 1.2 weight percent of magnesium, from 0.25 to 1 weight percent of iron and/or manganese, from 0.005 to 0.25 total weight percent of titanium and boron, and aluminum filling the rest together with impurities;

(b) casting and solidifying the molten material at a solidification rate equal to or faster than 4° C./sec; and (c) heat treating the material so that the alloy has a hardness between 67 and 75 according to the Rockwell hardness scale F, whereby the alloy develops improved shear cutting characteristics.

10. An aluminum alloy according to claim 9, wherein the silicon crystals in the aluminum-silicon eutectic structure are not larger than 5 um in average diameter.

11. An aluminum alloy according to claim 9 of which the hardness is between 69 to 73 according to the Rockwell hardness scale F.

12. An aluminum alloy according to claim 10 of which the hardness is between 69 to 73 according to the Rockwell hardness scale F.

* * * * *